US008056943B2

(12) United States Patent
Scheffy et al.

(10) Patent No.: US 8,056,943 B2
(45) **Date of Patent: *Nov. 15, 2011**

(54) FULL WIDTH OVERLAY DRAWER LATCH

(75) Inventors: Clark Scheffy, Cambridge, MA (US); Andy Deakin, San Francisco, CA (US); Sarah Hall "Sally" Madsen, San Francisco, CA (US)

(73) Assignee: Snap-On Incorporated, Kenosha, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/455,974

(22) Filed: Jun. 10, 2009

(65) Prior Publication Data

US 2009/0250944 A1 Oct. 8, 2009

Related U.S. Application Data

(63) Continuation of application No. 11/800,833, filed on May 8, 2007, now Pat. No. 7,552,950.

(51) Int. Cl.
*E05C 19/10* (2006.01)
*A47B 95/02* (2006.01)

(52) U.S. Cl. ..... 292/95; 292/100; 292/108; 292/126; 312/332.1; 312/348.6

(58) Field of Classification Search ..... 292/95
See application file for complete search history.

(56) References Cited

U.S. PATENT DOCUMENTS

| | | | | |
|---|---|---|---|---|
| 5,292,191 | A * | 3/1994 | Slivon | 312/332.1 |
| 5,403,139 | A * | 4/1995 | Slivon et al. | 312/332.1 |
| 5,775,140 | A * | 7/1998 | Hallsten | 70/85 |
| 6,375,235 | B1 * | 4/2002 | Mehmen | 292/128 |
| 6,527,353 | B1 * | 3/2003 | Bradfish et al. | 312/332.1 |
| 6,547,289 | B1 * | 4/2003 | Greenheck et al. | 292/126 |
| 6,550,824 | B1 * | 4/2003 | Ramsauer | 292/126 |
| 6,997,527 | B2 * | 2/2006 | Cheng | 312/332.1 |
| 7,048,347 | B1 * | 5/2006 | Liu | 312/332.1 |
| 7,552,950 | B2 * | 6/2009 | Scheffy et al. | 292/95 |

* cited by examiner

*Primary Examiner* — Carlos Lugo
(74) *Attorney, Agent, or Firm* — Seyfarth Shaw LLP

(57) ABSTRACT

A latching overlay for a tool storage unit drawer includes a drawer pull with a substantially horizontal flange portion perpendicular to a front face of the drawer and extending across at least a portion of the drawer width. In a preferred embodiment, the latching overlay includes a trim channel having a first surface for engaging a top face of the horizontal flange portion of the drawer pull, a second surface for engaging a bottom face of the horizontal flange portion of the drawer pull, and a release connected between the first surface and the second surface such that the trim channel is capable of pivoting about the horizontal flange portion. At least one drawer latch hook connected to the trim channel is provided, wherein the drawer latch hook engages and disengages from a latching component of the tool storage unit in response to the pivoting movement of the trim channel.

21 Claims, 3 Drawing Sheets

FULL WIDTH OVERLAY DRAWER LATCH

RELATED APPLICATIONS

The present application is a continuation of U.S. Ser. No. 11/800,833 filed May 8, 2007, now U.S. Pat. No. 7,552,950 the filing priority of which is claimed and the entire disclosure of which is hereby incorporated by reference.

TECHNICAL FIELD OF THE INVENTION

The present device relates to drawer latches for tool storage units. Particularly, the present device relates to a drawer pull overlay to provide a drawer latch for tool storage units.

BACKGROUND OF THE INVENTION

Storage units (or cabinets, as they are sometimes called) with drawers are typically constructed so that each drawer either automatically latches when closed or requires positive operation of an actuator to be latched. For example, filing cabinets have drawers that are usually of the automatic character, while drawers in some rolling cabinets in the marketplace require positive actuation to latch them closed. There are still many other such storage units currently in use that do not have either type of latching drawers. It should be understood that latch mechanisms are very different from key-operated locks that may be included in storage units to hold drawers in a closed and locked condition. This application deals only with drawer latches, not locks.

While many tool storage units are currently being manufactured with drawer latching mechanisms, some models (old and new) exist which have no such feature. The safety and convenience of having latching drawers is uncontroverted. However, retrofitting drawers with latching mechanisms has not been a simple undertaking. In most latch mechanisms, an actuator connects to the latch which can be pivoted or rotated between a latched and an unlatched condition. Issues such as the alignment of latching components, drilling holes, fastening components, and avoiding interference with existing structures are all factors which must be considered with prior art drawer latch mechanisms. In some cases, where a drawer pull extends across the entire drawer width, it can be more difficult to use a latching mechanism if the user is required to grasp the device at only one specific point to unlatch the drawer. In other cases, known drawer latch mechanisms require the use of two hands, one to unlatch the mechanism and the other to grasp the drawer pull and open the drawer.

The present device solves these and other problems associated with prior art devices by providing a full width drawer overlay which readily attaches to the drawer pull. The mechanism is less likely to open inadvertently when the unit on which it is used is rolled from one place to another. The user can grasp the drawer pull at any point along its extent to unlatch and open the drawer. The drawer latch mechanism is substantially concealed by the drawer pull. The mechanism can be unlatched and the drawer opened with one hand.

SUMMARY OF THE INVENTION

There is disclosed herein an improved drawer latch mechanism which avoids the disadvantages of prior devices while affording additional structural and operating advantages.

A latching overlay for a tool storage unit drawer having a drawer pull with a substantially horizontal flange portion perpendicular to a front face of the drawer and extending across at least a portion of the drawer width is disclosed. In a preferred embodiment, the latching overlay comprises a trim channel comprising a first surface for engaging a top face of the horizontal flange portion of the drawer pull, a second surface for engaging a bottom face of the horizontal flange portion of the drawer pull, and a release connected between the first surface and the second surface such that the trim channel is capable of pivoting about the horizontal flange portion. At least one drawer latch hook connected to the trim channel is provided, wherein the drawer latch hook engages and disengages from a latching component of the tool storage unit in response to the pivoting movement of the trim channel.

In one aspect of the latching overlay, the trim channel pivots the at least one drawer latch hook to disengage from the tool storage unit when a force is applied to the release. The force applied to the release is preferably directed substantially toward the first surface of the trim channel. An end cap is preferably connected to each open end of the trim channel with the at least one drawer latch hook being integral to an end cap.

In one aspect of the latching overlay the drawer latch hook has a sloped surface to contact the latching component of the storage unit as the drawer is closed and thereby pivots the trim channel upward from the horizontal flange portion until the drawer latch hook engages the latching component. The trim channel is weighted to pivot the trim channel downward once the latch hook is in place to latch.

These and other aspects of the invention may be understood more readily from the following description and the appended drawings.

BRIEF DESCRIPTION OF THE DRAWINGS

For the purpose of facilitating an understanding of the subject matter sought to be protected, there are illustrated in the accompanying drawings embodiments thereof, from an inspection of which, when considered in connection with the following description, the subject matter sought to be protected, its construction and operation, and many of its advantages should be readily understood and appreciated.

DETAILED DESCRIPTION OF PREFERRED EMBODIMENTS

Figure 1:
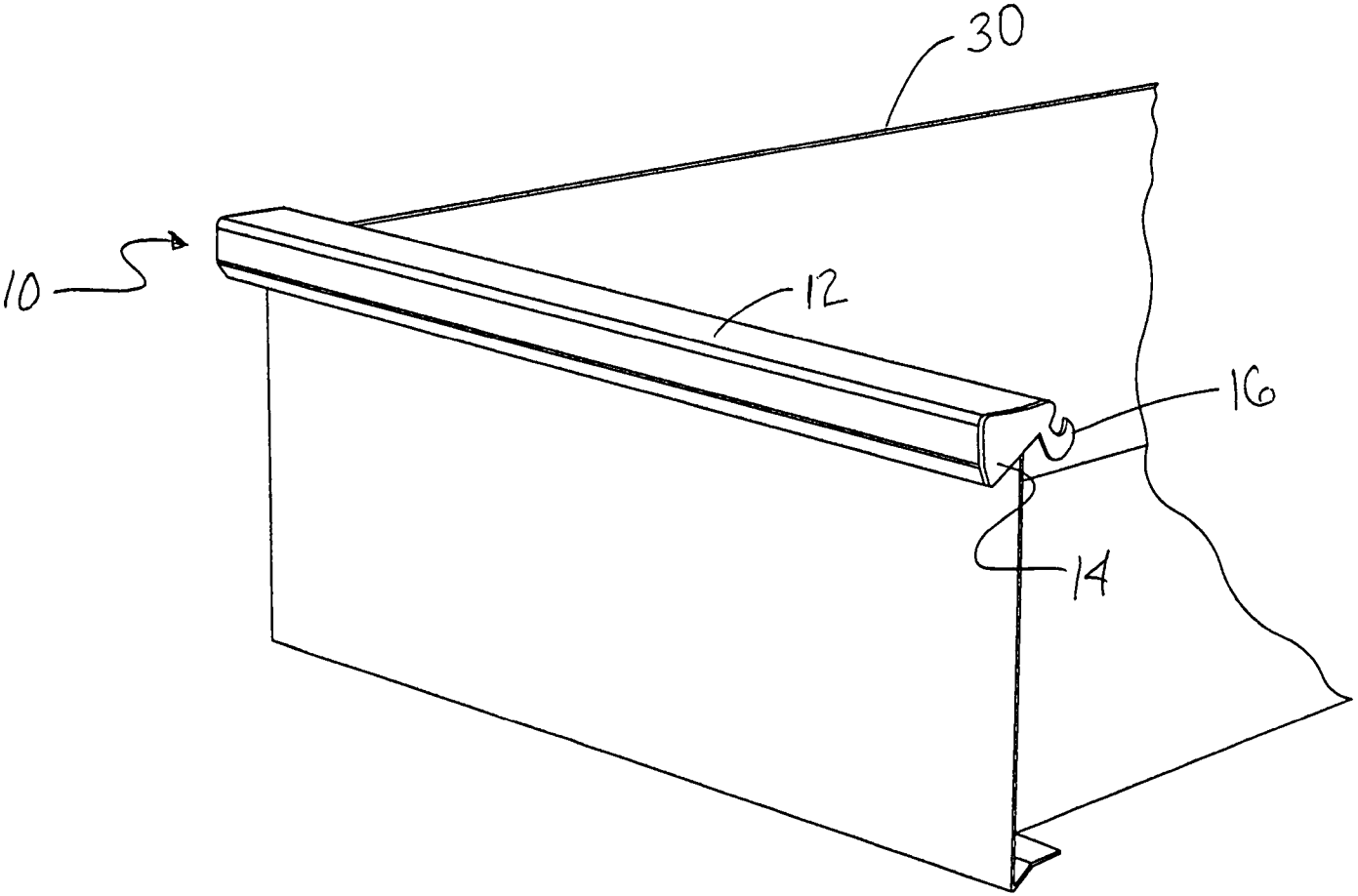
FIG. 1 is a perspective view of one embodiment of the latching overlay fitted to a drawer.

While this invention is susceptible of embodiments in many different forms, there is shown in the drawings and will herein be described in detail a preferred embodiment of the invention with the understanding that the present disclosure is to be considered as an exemplification of the principles of the invention and is not intended to limit the broad aspect of the invention to embodiments illustrated.

Figure 2:
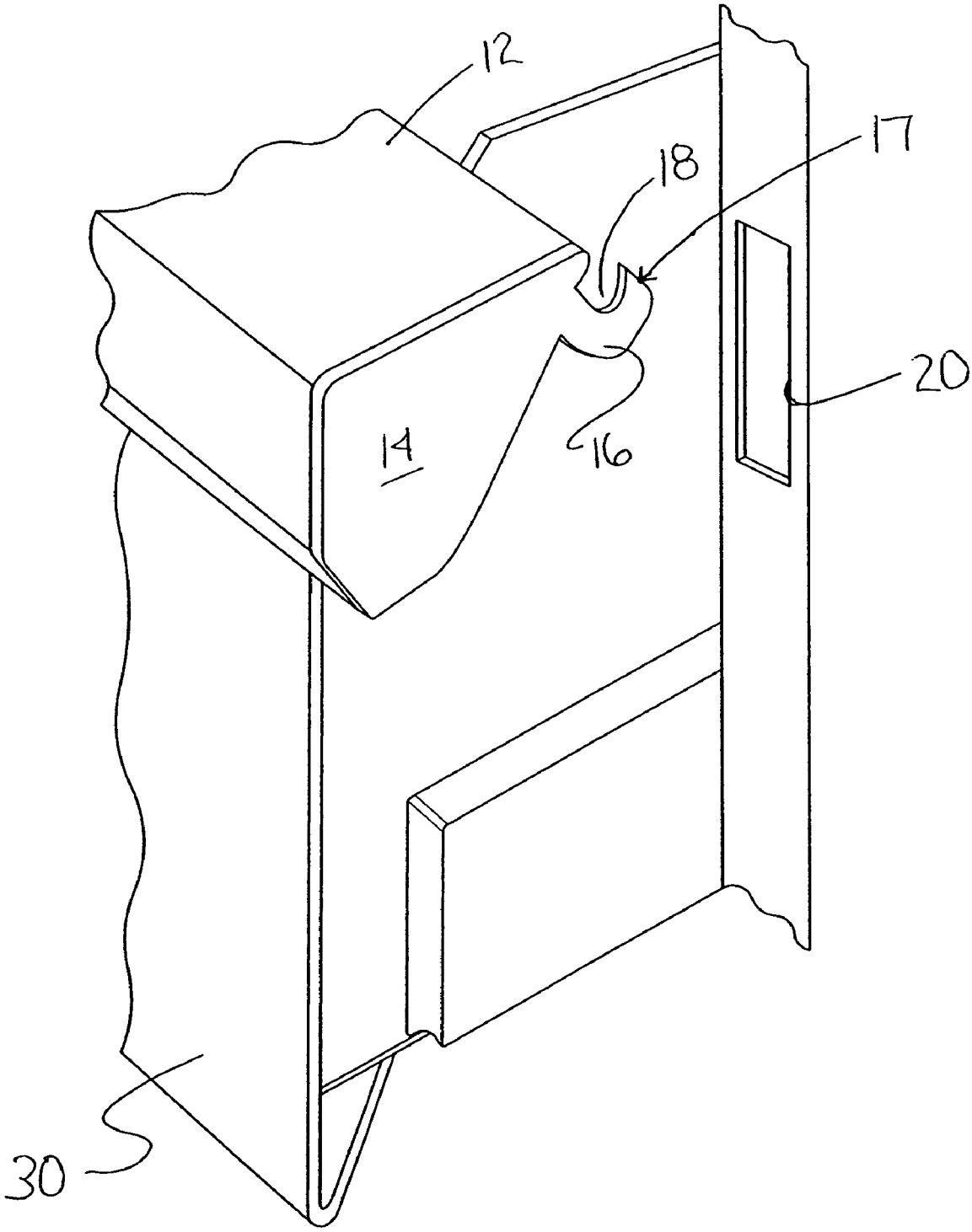
FIG. 2 is a partial view an embodiment of the overlay showing one end of the overlay.
Figure 3:
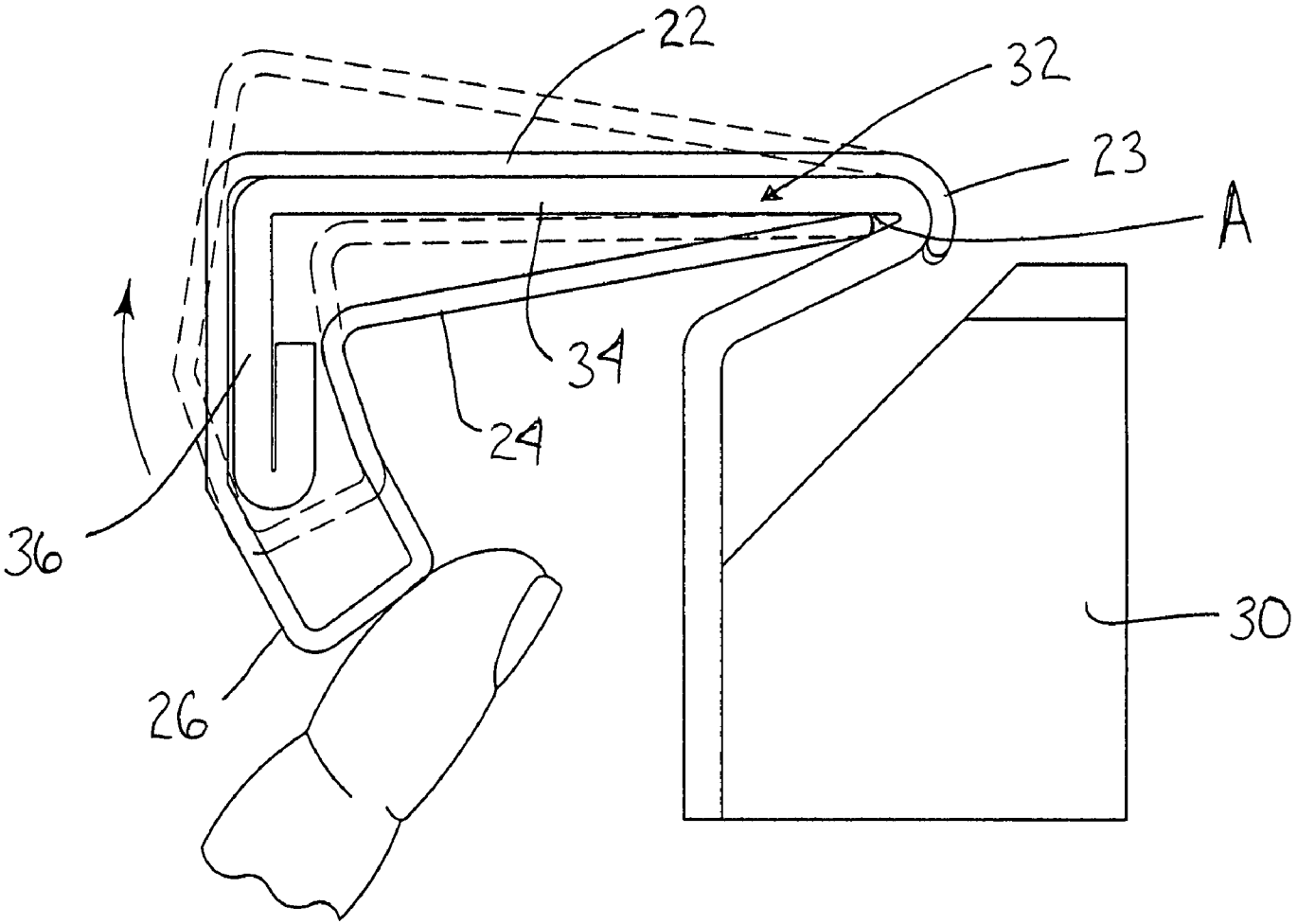
FIG. 3 is a cross section of the overlay illustrating the actuation of the release.

Referring to FIGS. 1-3, there is illustrated a full width drawer overlay latch, generally designated by the numeral 10. The storage unit typically is comprised of a frame carrying several drawers. The overlay 10 is designed for use on the sliding drawers, particularly drawers for a tool storage unit having a drawer pull 32 attached to the face of the drawer. FIG. 1 shows a preferred overlay 10 having a trim channel 12 with two ends (one shown) covered by end caps 14. The trim channel 12 is slid onto the drawer pull 32 from one end of the pull until it extends a short distance beyond each side of the drawer. The end caps 14 are then secured onto each open end of the trim channel 12. At least one of the end caps 14 includes a drawer latch hook 16 for securing the drawer to a latching component 20—e.g., a punch out opening in the frame of the storage unit—as shown in FIG. 2.

FIG. 3 shows the latching overlay 10 affixed to a tool storage unit drawer 30 having a drawer pull 32 with a substantially horizontal flange portion 34 perpendicular to a front face 36 of the drawer 30 and extending across at least a portion of the drawer width. The trim channel 12, which preferably extends the width of the drawer (FIG. 1), comprises a first surface 22 for engaging a top face of the horizontal flange portion 34 of the drawer pull 32, a second surface 24 for engaging a bottom face of the horizontal flange portion 34 of the drawer pull 32, and a release 26 connected between the first surface 22 and the second surface 24 such that the trim channel 12 is capable of pivoting about the horizontal flange portion 34 at point A when an upward force is applied to the release 26. An end cap 14 is preferably connected in any manner known to those skilled in the art to each open end of the trim channel 12. At least one drawer latch hook 16 integral to an end cap 14 engages and disengages from a latching component 20 of the tool storage unit in response to the pivoting movement of the trim channel 12. Obviously, each end cap 14 can include an integral latch hook 16.

When desired, an identifier support (not shown) may also be added to the trim channel 12 of the overlay 10. The identifier support can be used for supporting and displaying an associated identification card which lets the user know, for example, the contents of the drawer before opening or the name of the owner for the particular storage unit.

The trim channel 12 is preferably made of an extruded metal or strong, rigid plastic. The end caps 14 should be a compatible material and manufactured to fit within the open ends of the trim channel 12. The first surface 22 of the trim channel 12 is a substantially straight section with a short radiused section 23 along the edge. The radiused section 23 facilitates engagement with the top surface of the horizontal flange portion 34 and prevents undesirable travel of the trim channel 12 during pivoting motion. The second surface 24 contacts the lower surface of the horizontal flange portion 34 at point A and diverges therefrom as the surface 24 extends toward a vertical flange portion 36. The release 26 is comprised, in the present embodiment, of a plurality of adjoined surfaces configured to connect the first surface 22 to the second surface 24. The release 26 is spaced from the drawer pull to allow for pivoting movement in the direction of arrow of FIG. 3. Other configurations of the release 26 are certainly possible without departing from the intended scope of the present application.

It is desired to contour the release 26 such that the natural grasp and pull by a user of the storage unit drawer will effect disengagement of the drawer latch hook 16. This feature would allow the user to grip and pull at the drawer pull 32 in a normal manner to pivot the release, and thus also pivot the entire trim channel 12 upward about point A of FIG. 3. With the disclosed pivot motion of the trim channel 12, the attached end caps 14 are also pivoted about a corresponding point. As a result of the pivot point A, as the release 26 pivots upward, the drawer latch hook 16 on the opposite side of point A pivots downward. With the drawer latch hooks 16 pivoting downward, the upward turned opening 18 of the latch hooks 16 disengage from the respective latching component 20 of the storage unit frame. When the drawer latch hooks 16 are disengaged, the drawer is capable of being opened. This disengaging and opening occurs in a single motion. As an added benefit, the grasp and pull motion described can be accomplished with a single hand in many cases.

To close the drawer and engage the drawer latch hook 16 within the latching component 20 of the storage unit, the drawer need only be closed. Referring to FIG. 2, the latch hook 16 is shown to have an angled face 17. As the drawer is closed, the angled face 17 engages the latching component 20 and pivots the drawer latch hooks 16 downward, opposite the trim channel 12, as the hooks 16 continue to slide into the latching components 20. Once the angled face 17 clears the latching component 20, the trim channel 12—which is weighted and configured to succumb to the force of gravity—is pulled downward to drop back into engagement with the horizontal flange portion 34 of the drawer pull. The drop of the trim channel 12 also results in (and indicates) the engagement of the hook opening 18 of the latch hooks 16 with the latching component 20. The reliance on gravity eliminates the need for using a resilient member, such as a spring, to return the trim channel 12 and hook 16 to the engaged position.

The matter set forth in the foregoing description and accompanying drawings is offered by way of illustration only and not as a limitation. While particular embodiments have been shown and described, it will be apparent to those skilled in the art that changes and modifications may be made without departing from the broader aspects of applicants' contribution. The actual scope of the protection sought is intended to be defined in the following claims when viewed in their proper perspective based on the prior art.

What is claimed is:

1. A latching overlay on a tool storage unit drawer having a drawer pull with a flange portion, the latching overlay comprising:

a trim channel including:

a first surface configured to engage a first face of the horizontal flange portion of the drawer pull, the first surface including a first end;

a second surface configured to engage a second face of the flange portion, the second surface including a second end;

a release connecting the first surface and the second surface;

an opening defined by the first end and second end, the opening adapted to receive an end of the drawer pull and allow the first and second ends to move substantially horizontally along a width of the drawer pull during installation of the trim channel on the drawer pull; and a body including a drawer latch hook configured to pivot with the trim channel outside a tool storage space of the drawer, the drawer latch hook configured to engage and disengage from a latching component of the tool storage unit in response to the pivoting movement of the trim channel.

2. The latching overlay of claim 1, wherein the trim channel pivots the at least one drawer latch hook to disengage from the tool storage unit.

3. The latching overlay of claim 2, wherein the release is adapted to pivot the trim channel about the flange portion when a force is applied to the release, wherein the force is directed substantially toward the first surface.

4. The latching overlay of claim 1, further comprising a stop that restricts the pivoting movement of the trim channel.

5. The latching overlay of claim 4, wherein the stop comprises the second surface abutting the horizontal flange portion.

6. The latching overlay of claim 1, wherein the body is an end cap connected to an open end of the trim channel.

7. The latching overlay of claim 6, wherein the at least one drawer latch hook is formed on a surface of the end cap.

8. The latching overlay of claim 1, wherein the trim channel extends at least the width of the drawer.

9. The latching overlay of claim 1, wherein the trim channel slides onto the drawer pull of the storage unit.

10. The latching overlay of claim 1, wherein the drawer latch hook has a sloped surface configured to contact the latching component of the storage unit as the drawer is closed and to pivot the trim channel upward from the horizontal flange portion until the drawer latch hook engages the latching component.

11. The latching overlay of claim 10, wherein the trim channel is weighted to pivot the trim channel downward.

12. The latching overlay of claim 1, further comprising a second drawer latch hook.

13. The latching overlay of Claim 12, wherein the drawer latch hook and the second drawer latch hook are disposed on opposite sides of the trim channel.

14. The latching overlay of claim 1, wherein the release is adapted to pivot the trim channel and disengage the drawer from the storage unit by pulling outward at the release.

15. A latching overlay on a tool storage unit drawer having a drawer pull with a flange portion, the latching overlay comprising:

a trim channel comprising:

a first surface configured to engage a top face of the horizontal flange portion of the drawer pull, the first surface including a first end;

a second surface configured to engage a bottom face of the horizontal flange portion of the drawer pull, the second surface including a second end;

an opening defined by the first end and second end, the opening configured to receive an end of the drawer pull and allow the first and second ends to move horizontally along a width of the drawer pull during installation of the trim channel on the drawer pull; and a release connecting the first surface and the second surface distal to the first and second ends, the release configured to pivot the trim channel about the horizontal flange portion when a force is applied to the release; and at least one body including a drawer latch hook configured to pivot with the trim channel outside a tool storage space of the drawer, the drawer latch hook configured to engage and disengage from a latching component of the tool storage unit in response to the pivoting movement of the trim channel.

16. A drawer latch apparatus comprising:

an elongated structure including:

a first internal planar surface having a first end;

a second internal planar surface having a second end and opposing the first internal planar surface, the second internal planar surface being angularly disposed relative to the first internal planar surface by an internal angle;

an elongated wall portion connecting the first internal planar surface and the second internal planar surface; and an opening defined by the first end and second end, the opening adapted to receive a portion of the drawer and allow the first and second ends to move substantially horizontally along a width of the drawer during installation of the elongated structure on the drawer; and a body having a hook configured to pivot with the elongated structure through the portion of the angle to engage a latching component of the drawer.

17. The drawer latch apparatus of claim 16, wherein when the elongated structure is in the first position the first internal planar surface is configured to abut a top surface of the elongated flange of the drawer and the hook is configured to engage the latching component of the drawer.

18. The drawer latch apparatus of claim 16, wherein when the elongated structure is in the second position the first internal planar surface is configured be displaced from a top surface of the elongated flange of the drawer and the hook is configured to disengage the latching component of the drawer.

19. The drawer latch apparatus of claim 16, further comprising:

an elongated curved surface extending from the first internal planar surface proximal to the angle.

20. The drawer latch apparatus of claim 16, further comprising:

at least one end cap connected to an end of the elongated structure.

21. The drawer latch apparatus of claim 20, wherein the hook is integral to the at least one end cap.

* * * * *